US005553648A

United States Patent [19]

Goharjou

[11] Patent Number: 5,553,648

[45] Date of Patent: Sep. 10, 1996

[54] PORTABLE WALL SYSTEM

[76] Inventor: Ardavan Goharjou, 615 N. Elm St., Woodland Park, Colo. 80863

[21] Appl. No.: 514,684

[22] Filed: Aug. 14, 1995

[51] Int. Cl.[6] ..... A47G 5/00; A47H 23/00; E04H 15/02; E04H 17/16

[52] U.S. Cl. ..... 160/135; 160/237; 160/351; 160/377; 52/587.1; 52/645; 135/127; 135/139; 135/900; 256/24; 256/45; 256/DIG. 2

[58] Field of Search ..... 160/135, 351, 160/377, 63, 237; 52/239, 148, 146, 645, 646, 222, 587.1; 135/139, 140, 127, 900; 256/13.1, 24, 26, 45, DIG. 2

[56] References Cited

U.S. PATENT DOCUMENTS

| | | | |
|---|---|---|---|
| 2,024,090 | 12/1935 | Cadmus | 160/237 |
| 3,016,952 | 1/1962 | Shero | 160/377 |
| 3,223,098 | 12/1965 | Dole, Jr. | 135/127 X |
| 3,280,521 | 10/1966 | Keathly | 52/148 |
| 3,834,410 | 9/1974 | Leibel | 135/127 X |
| 4,214,392 | 7/1980 | Virsen | 160/135 X |
| 4,371,148 | 2/1983 | Harden | 160/135 X |
| 4,614,502 | 9/1986 | Nelson | 52/645 X |
| 4,893,668 | 1/1990 | Nomura | 160/354 X |
| 5,407,178 | 4/1995 | Long | 160/354 X |
| 5,414,950 | 5/1995 | Johnson, Sr. | 160/135 X |
| 5,487,402 | 1/1996 | Clary | 135/139 X |

*Primary Examiner*—Blair Johnson
*Assistant Examiner*—Bruce K. Lev

[57] ABSTRACT

A portable wall component is disclosed. The wall component comprises a pair of vertical posts. Each post has an upper component and a lower component with a hollow aperture extending therethrough. Each post also has a downwardly extending smaller cylindrical section at the bottom of the upper component and a complimentary cylindrical recess at the top of the lower post for receiving the smaller cylindrical section. An elastic band is located within each aperture extending along the length thereon and slightly beyond. A ring at the upper end of each upper component is coupled to the upper end of its associated band. A base component at the lower end of each lower component is coupled to the lower end of its associated band. A flexible sheet is provided with parallel upper and lower horizontal edges and parallel vertical end edges therebetween coupled to the posts. The flexible sheet has half-moon wind flaps cut therein and openings at the regions where the upper and lower components join.

4 Claims, 4 Drawing Sheets

FIG 3
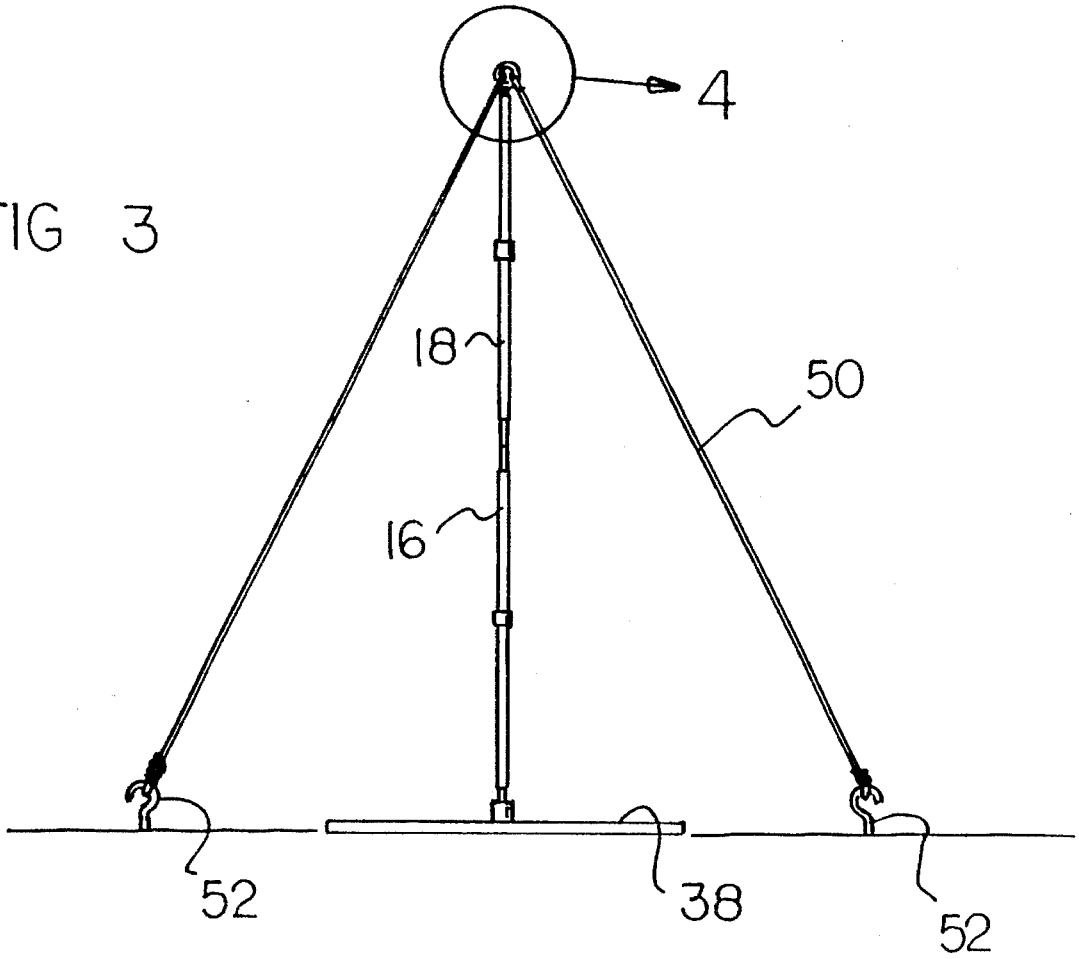
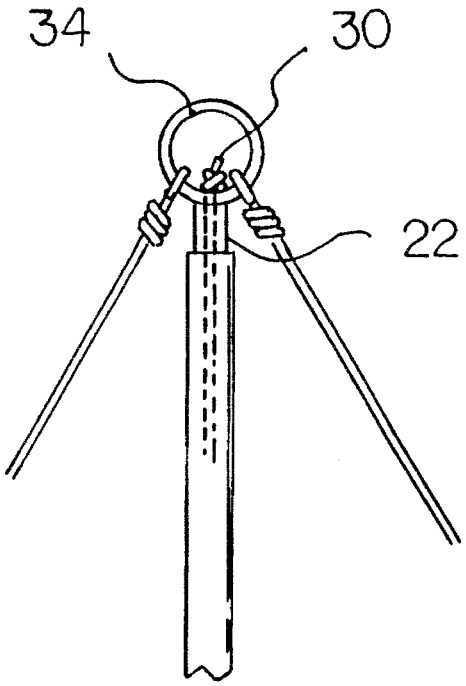
FIG 4

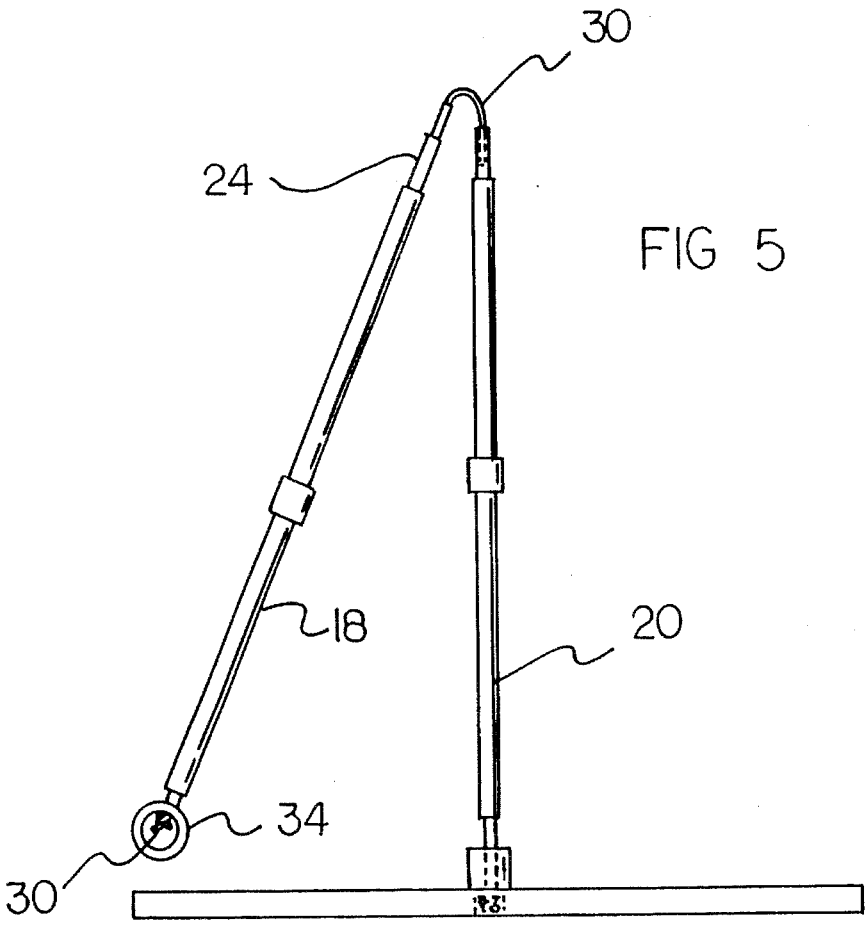
FIG 5
FIG 6
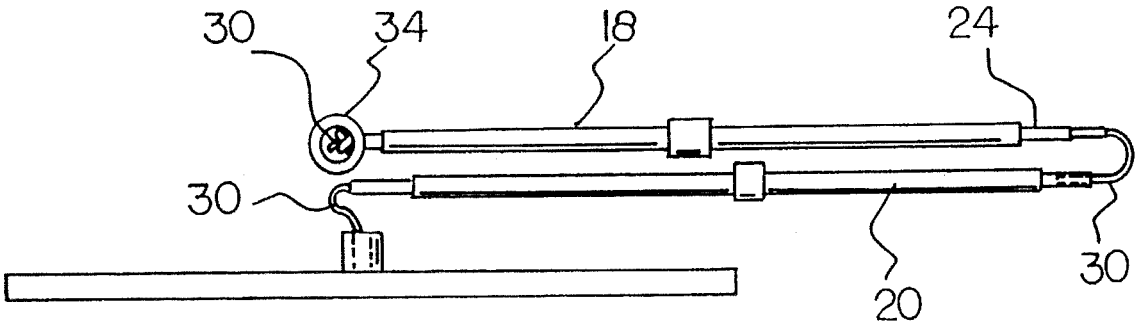

PORTABLE WALL SYSTEM

BACKGROUND OF THE INVENTION

1. Field of the Invention

The present invention relates to a new and improved portable wall system and, more particularly, pertains to restricting the view of motorists in accident areas through a lightweight, readily collapsible portable wall.

2. Description of the Prior Art

The use of walls and other vision-restricting devices of various designs and configurations is known in the prior art. More specifically, walls and other vision-restricting devices of various designs and configurations heretofore devised and utilized for the purpose of restricting the view of people through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for restricting the view of motorists in accident areas through a lightweight, readily collapsible portable wall. By way of example, U.S. Pat. No. 3,987,836 to LeMay discloses a screen partition assembly in a modular configuration.

U.S. Pat. No. 4,104,838 to Hage et al. discloses a portable wall assembly with one or more panels supported by removably attached posts.

U.S. Pat. No. 4,134,439 to Scott discloses a portable industrial screen composed of frames with juxtaposed grooves and a rubber band hinge arrangement.

U.S. Pat. No. 4,928,465 to Del Castillo Von Haucke discloses modular privacy screen assemblies having one or more panels with joining members in a channel formation.

Lastly, U.S. Pat. No. 5,287,909 to King et al. discloses a freestanding privacy screen comprised of a plurality of like panels joined together by hinge rods.

In this respect, the portable wall system according to the present invention substantially departs from the conventional concepts and designs of the prior art, and in doing so provides an apparatus primarily developed for the purpose of restricting the view of motorists in accident areas through a lightweight, readily collapsible portable wall.

Therefore, it can be appreciated that there exists a continuing need for a new and improved portable wall system which can be used for restricting the view of motorists in accident areas through a lightweight, readily collapsible portable wall. In this regard, the present invention substantially fulfills this need.

SUMMARY OF THE INVENTION

In view of the foregoing disadvantages inherent in the known types of walls and other vision restricting devices of various designs and configurations now present in the prior art, the present invention provides an improved portable wall system. As such, the general purpose of the present invention, which will be described subsequently in greater detail, is to provide a new and improved portable wall system and methods which have all the advantages of the prior art and none of the disadvantages.

To attain this, the present invention essentially comprises a portable wall system formed of a plurality of single units coupleable together, each unit comprising a pair of vertical posts, each post having an upper component and a lower component, with each post having a hollow aperture extending therethrough, each post having a downwardly extending smaller cylindrical section at the bottom of the upper component and a complimentary cylindrical recess at the top of the lower post for receiving the smaller cylindrical section; an elastic band within each aperture extending along the length thereon and slightly beyond; a ring at the upper end of each upper component coupled to the upper end of its associated band; a base component at the lower end of each lower component coupled to the lower end of its associated band; a flexible sheet having parallel upper and lower horizontal edges and parallel vertical end edges therebetween coupled to the posts, the flexible sheet having half-moon wind flaps cut therein and openings at the regions where the upper and lower components join; stabilizing cords coupled at their upper extents to an associated ring and having hooks secured to the ground at the lower ends of the stabilizing cords on opposite sides of the sheet for providing stability to the system; and a plurality of outwardly extending fingers projecting downwardly from one component and a plurality of complimentary eyelets on the other component of each unit for allowing the coupling together of units in a systems configuration.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable wall system which has all the advantages of the prior art walls and other vision restricting devices of various designs and configurations and none of the disadvantages.

It is another object of the present invention to provide a new and improved portable wall system which may be easily and efficiently manufactured and marketed.

It is a further object of the present invention to provide a new and improved portable wall system which is of a durable and reliable construction.

An even further object of the present invention is to provide a new and improved portable wall system which is susceptible of a low cost of manufacture with regard to both materials and labor, and which accordingly is then susceptible of low prices of sale to the consuming public, thereby making such walls and other vision restricting devices of various designs and configurations economically available to the buying public.

Still yet another object of the present invention is to provide a new and improved portable wall system which provides in the apparatuses and methods of the prior art some of the advantages thereof, while simultaneously overcoming some of the disadvantages normally associated therewith.

Even still another object of the present invention is to restrict the view of motorists in accident areas through a lightweight, readily collapsible portable wall.

Lastly, it is an object of the present invention to provide a portable wall component. The wall component comprises a pair of vertical posts. Each post has an upper component and a lower component with a hollow aperture extending therethrough. Each post also has a downwardly extending smaller cylindrical section at the bottom of the upper component and a complimentary cylindrical recess at the top of the lower post for receiving the smaller cylindrical section. An elastic band is located within each aperture extending along the length thereon and slightly beyond. A ring at the upper end of each upper component is coupled to the upper end of its associated band. A base component at the lower end of each lower component is coupled to the lower end of its associated band. A flexible sheet is provided with parallel upper and lower horizontal edges and parallel vertical end edges therebetween coupled to the posts. The flexible sheet has half-moon wind flaps cut therein and openings at the regions where the upper and lower components join.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the unit shown in FIG. 1.

FIG. 4 is an enlarged side elevational view taken at circle 4 of FIG. 3.

FIG. 5 is a view similar to FIG. 3 but with the stabilizing cords removed and with the device in a partially collapsed orientation.

FIG. 6 is a view similar to FIG. 5 but in the fully collapsed orientation.

The same reference numerals refer to the same parts throughout the various Figures.

DESCRIPTION OF THE PREFERRED EMBODIMENT

Figure 1:
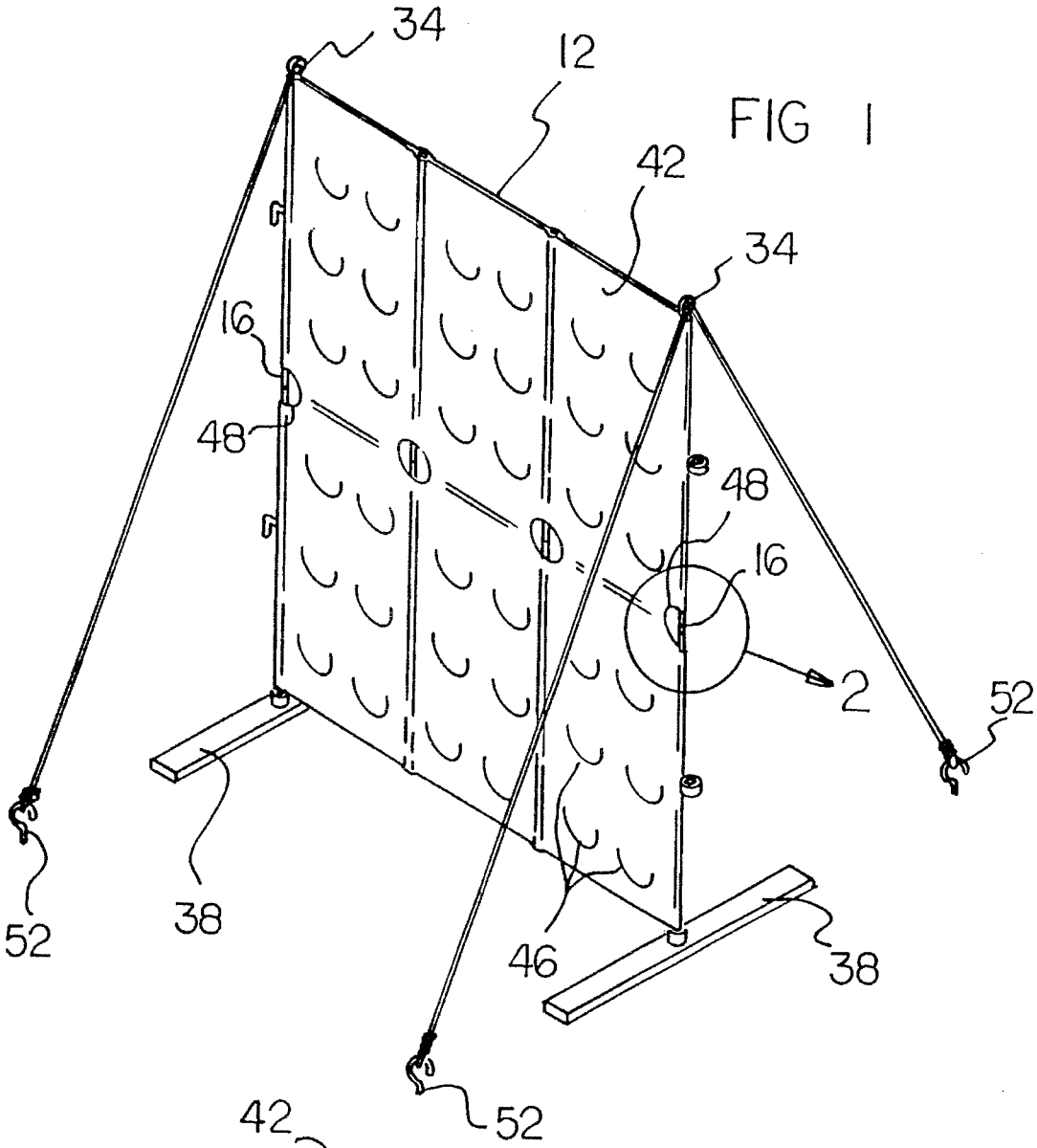
FIG. 1 is a perspective view of the preferred embodiment of the new and improved portable wall component constructed in accordance with the principles of the present invention.
Figure 2:
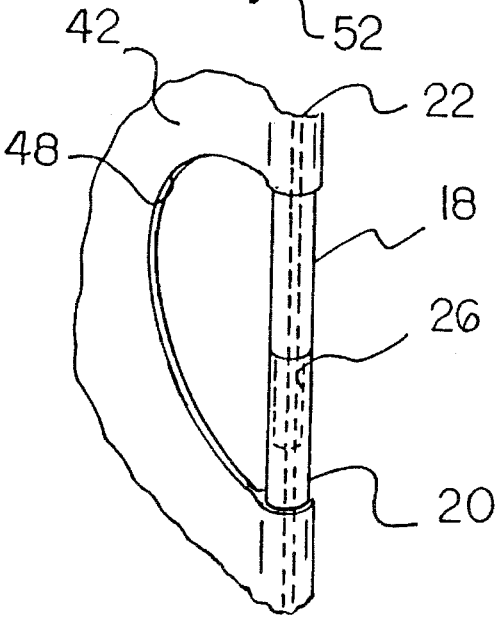
FIG. 2 is an enlarged perspective view of the portion of the unit shown in FIG. 1 taken at circle 2 of FIG. 1.
Figure 7:
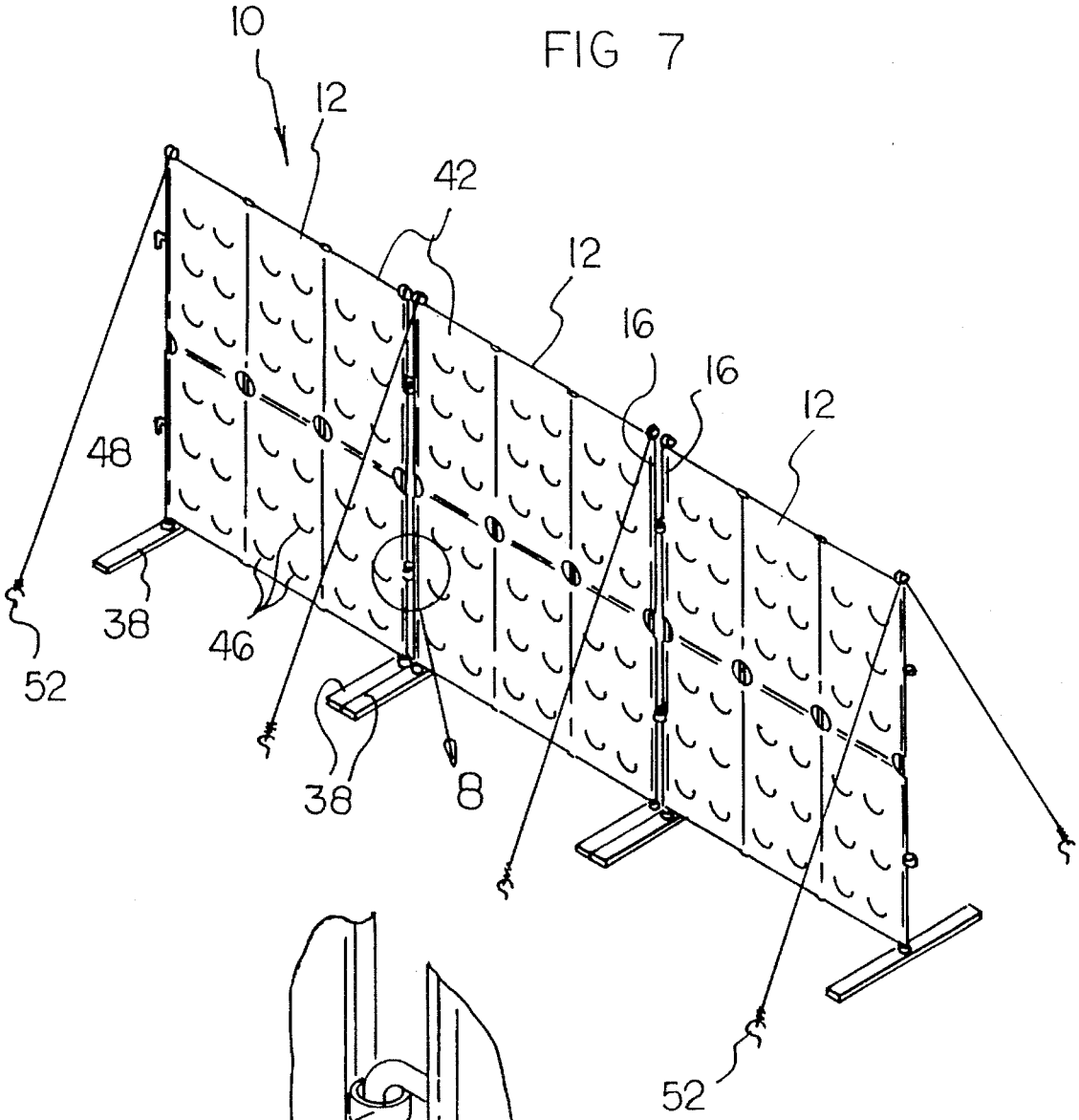
FIG. 7 is a perspective view of a plurality of units shown in FIG. 1 but coupled together in a systems configuration.
Figure 8:
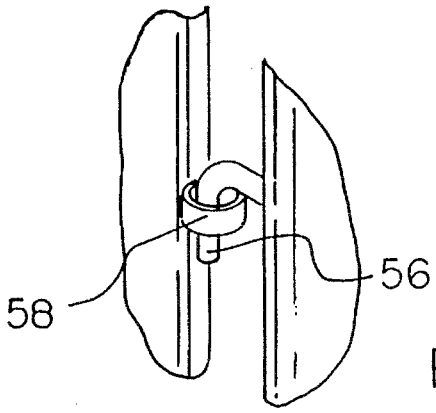
FIG. 8 is an enlarged perspective view taken at circle 8 of FIG. 7.

With reference now to the drawings, and in particular to FIG. 1 thereof, the preferred embodiment of the new and improved portable wall system embodying the principles and concepts of the present invention and generally designated by the reference numeral 10 will be described.

The present invention, the new and improved portable wall system is a system 10 comprised of a plurality of components. In their broadest context, the components include a pair of vertical posts, an elastic band, a ring, a base component, a flexible sheet, stabilizing cords and a plurality of fingers. Each of the individual components is specifically configured and correlated one with respect to the other so as to attain the desired objectives.

More specifically, the present invention is in a portable wall system 10. Such system is formed of a plurality of single units 12. The units are of a common configuration. Such units are coupleable together for the intended purpose of obscuring the vision of motorists in an accident area.

The central component of each system 10 is the unit 12 while the central components of each unit are a pair of vertical posts 16. Each post is formed with an upper cylindrical component 18 and a lower cylindrical component 20. Each post with its associated components has a hollow aperture 22 extending therethrough. Secure coupling therebetween during operation and use is enhanced through the formation of a downwardly extending smaller cylindrical section 24 at the bottom of the upper component. In association therewith, a complimentary cylindrical recess 26 is formed at the top end of the lower component of each post. The recess is for receiving the small cylindrical section to maintain them properly coupled during operation and use but to allow separation thereof for disassembly, storage and transportation purposes.

The next component of each unit is a pair of elastic bands 30. Each band is within an aperture of an associated post. The aperture extends along the entire length of each post and slightly beyond.

Next provided is a ring 34. Actually, a pair of rings are provided with one ring at the upper end of each upper component. Such ring is coupled to the upper end of its associated cord. The opposite end of the cord is secured to a base component 38 at the lower end of each lower component. The base components are heavy units to add stability and extend horizontally on the recipient surface such as a road. They extend parallel with each other perpendicular to the axes of the posts.

A flexible sheet 42 is next provided. Such sheet is provided for each unit and has parallel upper and lower horizontal edges. Each flexible sheet also has vertical end edges 44 spaced from each other the distance of the lateral dimension of the unit. The vertical end edges of the sheet are coupled to the posts along their length. The flexible sheet is formed with half-moon wind flaps 46. Such allow for the movement of wind therethrough to promote the stability of the unit during windy days. In addition, such flaps are cut into the sheet in plural rows and plural columns. In addition, openings 48 are cut into the sheet at the regions where the upper and lower components of the posts join.

Stabilizing cords 50 are next provided. A pair of cords are provided for each ring at the upper extent of each post. The upper ends of the cords are secured to the ring as through tying. In addition, hooks 52 are secured to the ground on opposite sides of the sheet, preferably beyond the base components. The lower ends of the stabilizing cords are secured to such hooks and when four such stabilizing cords are coupled to the upper lateral extents of each unit, the system is effectively stabilized during all but the most extreme wind conditions.

Lastly provided are a plurality of outwardly extending fingers 56. Such fingers extend outwardly from one of the posts of each unit. They extend horizontally and then downwardly vertically. In association therewith on the other post of each unit are a plurality of eyelets 58. The eyelets are formed with vertical axes and are at elevations to receive the fingers from an adjacent unit. Together the fingers of one unit will couple to the eyelets of another unit to couple together a plurality of units in a systems configuration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A portable wall system formed of a plurality of single units coupleable together, each unit comprising:

a pair of cylindrical vertical posts, each post having an upper component and a lower component, with each post having a hollow aperture extending therethrough, each post having a downwardly extending smaller cylindrical section at the bottom of the upper component and a complimentary cylindrical recess at the top of the lower component for receiving the smaller cylindrical section;

an elastic band within each aperture extending along the length therethrough and slightly beyond;

a ring at the upper end of each upper component coupled to the upper end of its associated band;

a base component at the lower end of each lower component coupled to the lower end of its associated band;

a flexible sheet having parallel upper and lower horizontal edges, parallel vertical end edges, and opposite side therebetween coupled to the posts, the flexible sheet having half-moon wind flaps cut therein and openings at regions where the upper and lower components join;

stabilizing cords coupled at their upper extents to an associated ring and having hooks adapted to be secured to the ground at the lower ends of the stabilizing cords on opposite sides of the sheet for providing stability to the system; and a plurality of outwardly extending fingers projecting downwardly from one component and a plurality of complimentary eyelets on the other component of each unit for allowing the coupling together of units in a systems configuration.

2. A portable wall component comprising:

a pair of cylindrical vertical posts, each post having an upper component and a lower component, with each post having a hollow aperture extending therethrough, each post having a downwardly extending smaller cylindrical section at the bottom of the upper component and a complimentary cylindrical recess at the top of the lower component for receiving the smaller cylindrical section;

an elastic band within each aperture extending along the length therethrough and slightly beyond;

a ring at the upper end of each upper component coupled to the upper end of its associated band;

a base component at the lower end of each lower component coupled to the lower end of its associated band; and a flexible sheet having parallel upper and lower horizontal edges, parallel vertical end edges, and opposite side therebetween coupled to the posts, the flexible sheet having half-moon wind flaps cut therein and openings at regions where the upper and lower components join.

3. The component as set forth in claim 2 and further comprising:

stabilizing cords coupled at their upper extents to an associated ring and having hooks adapted to be secured to the ground at the lower ends of the stabilizing cords on opposite sides of the sheet for providing stability to the system.

4. The component as set forth in claim 2 and further comprising:

a plurality of outwardly extending fingers projecting downwardly from one component and a plurality of complimentary eyelets on the other component of each unit for allowing the coupling together of units in a systems configuration.

* * * * *